US005887817A

United States Patent [19]

Kudrus et al.

[11] Patent Number: 5,887,817

[45] Date of Patent: Mar. 30, 1999

[54] CROSS-WINDING DEVICE

[75] Inventors: Heiner Kudrus, Barmstedt; Werner Früchting, Hohenlockstedt, both of Germany

[73] Assignee: Neumag—Neumuenstersche Maschinen und Analgenbau GmbH, Neumuenster, Germany

[21] Appl. No.: 913,545

[22] PCT Filed: Dec. 15, 1995

[86] PCT No.: PCT/EP95/04962

§ 371 Date: Aug. 25, 1997

§ 102(e) Date: Aug. 25, 1997

[87] PCT Pub. No.: WO96/26149

PCT Pub. Date: Aug. 29, 1996

[30] Foreign Application Priority Data

Feb. 24, 1995 [DE] Germany ..... 295 03 084.4

[51] Int. Cl.[6] ..... B65H 54/28

[52] U.S. Cl. ..... 242/481.7

[58] Field of Search ..... 242/477.1, 480.8, 242/481.7

[56] References Cited

U.S. PATENT DOCUMENTS

| | | | |
|---|---|---|---|
| 3,489,360 | 1/1970 | Torsellini et al. | 242/481.7 |
| 4,505,437 | 3/1985 | Schippers et al. | 242/481.7 |
| 4,646,983 | 3/1987 | Schippers et al. | 242/481.7 |
| 4,991,783 | 2/1991 | Sugioka | 242/477.1 |

FOREIGN PATENT DOCUMENTS

| | | |
|---|---|---|
| 20 25 149 | 11/1970 | Germany . |
| 8507650.3 | 8/1986 | Germany . |
| 36 14 831 | 11/1986 | Germany . |
| 3826130A1 | 2/1989 | Germany . |
| 9307746.7 | 9/1993 | Germany . |

*Primary Examiner*—Michael Mansen
*Attorney, Agent, or Firm*—Michael J. Striker

[57] ABSTRACT

A traversing device has a housing, two rotors supported in the housing and having axes located parallel to one another and spaced apart from one another by at most a slight distance, each of the rotors having at least two vanes arranged in the manner of a propeller so that between rotation planes of two vanes assemblies there is a short distance, a gear which couples the two rotors and drives the rotors so that one of the rotors is drivable in one direction while the other of the rotors is drivable in another opposite direction, a straightedge located in a parallel plane adjacent to two rotation planes and having a guide edge whose end points essentially correspond to turning points of a traversing motion, retaining devices and fasteners connecting the straight edge to the housing so as to permit a relative displacement, the straightedge being secured adjustably to the retaining devices that are rigidly connected to the housing so that the straightedge is directly connected with the housing, and adjusting device arranged outside orbits of the vanes and a side of the traversing device which is opposite to a machine frame and being freely accessible from the side for performing the adjustment during operation of the traversing device.

5 Claims, 5 Drawing Sheets

CROSS-WINDING DEVICE

BACKGROUND OF THE INVENTION

The invention relates to a traversing device.

In traversing devices that have vanes, unlike conventional traversing devices, the alternating motion of the yarn is brought about not by a single yarn guide moved back and forth but rather by contrarily rotating vanes whose tips alternatingly engage and guide the yarn. The yarn-guiding vane tip sweeps over the straightedge, so that the yarn slides back and forth along the guide edge. The distance between the end points of the guide edge is therefore substantially equivalent to the traversing stroke. The orbits of the vanes intersect the guide edge in the vicinity of the end points. The speed component at which the yarn is moved crosswise to its travel direction depends on the one hand on the angular speed at which the vanes revolve and the other on the radial distance between the pivot axis and the point of the vane tip on which the yarn momentarily rests. By means of the form of the guide edge, a motion component that is radial to the orbits of the vanes is forced upon the yarn. As a result, the course of the speed at which the yarn moves along the traversing path can be varied, for instance in such a way that the speed component in the direction of the traversing stroke is substantially constant over the entire path. The exact location of the straightedge is therefore of the greatest importance in bobbin building.

From German Utility Model DE 85 07 650 U, a traversing device is known in which a drivable hollow shaft of one rotor is supported in a housing. The shaft of the second rotor is supported in the housing concentrically or eccentrically to the shaft of the first rotor. The shaft of the second rotor is driven by toothing in the inside circumference of the hollow shaft via a lay shaft also supported in the housing. To enable play-free gear adjustment upon assembly, the shaft of the second rotor like the lay shaft, is seated in a rotatable eccentric bushing. The rotation of the two eccentric bushings has the secondary effect that the connecting line between the pivot axes of the two rotors is shifted relative to the straightedge. To compensate for this undesired shifting, the housing is rotatable and fixable relative to the straightedge about the axis of the hollow shaft. To that end, oblong slots are provided in the lid to which the housing is secured.

German Patent Disclosure DE-OS 38 26 130 describes a device in which the location of the straightedge is varied regularly at predetermined time intervals during bobbin travel. Depending on how the location is varied, at least one end of the stroke is thus shifted. This is intended to prevent the formation of a bead at the ends of the winding. This reference provides no information on the structural characteristics that enable or accomplish the positional change of the straightedge.

SUMMARY OF THE INVENTION

The object of the invention is to create a traverse device in which the straightedge can be adjusted by hand during operation.

In keeping with these objects and with others which will become apparent hereinafter, one feature of present invention resides, briefly stated, in a traversing device in which a straightedge is secured adjustably to retaining devices that are rigidly connected to a housing, and adjusting means for performing the adjustment are disposed freely accessible outside the orbits of vanes of the device.

Figure 4B:
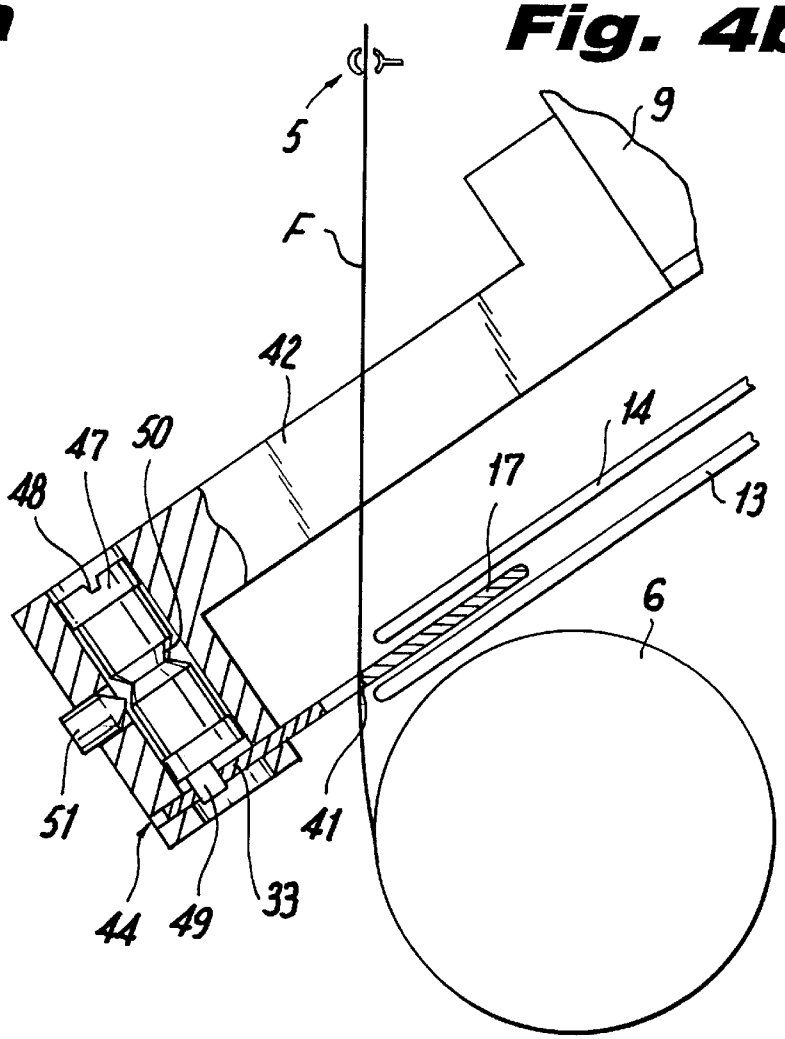
Figure 4A:
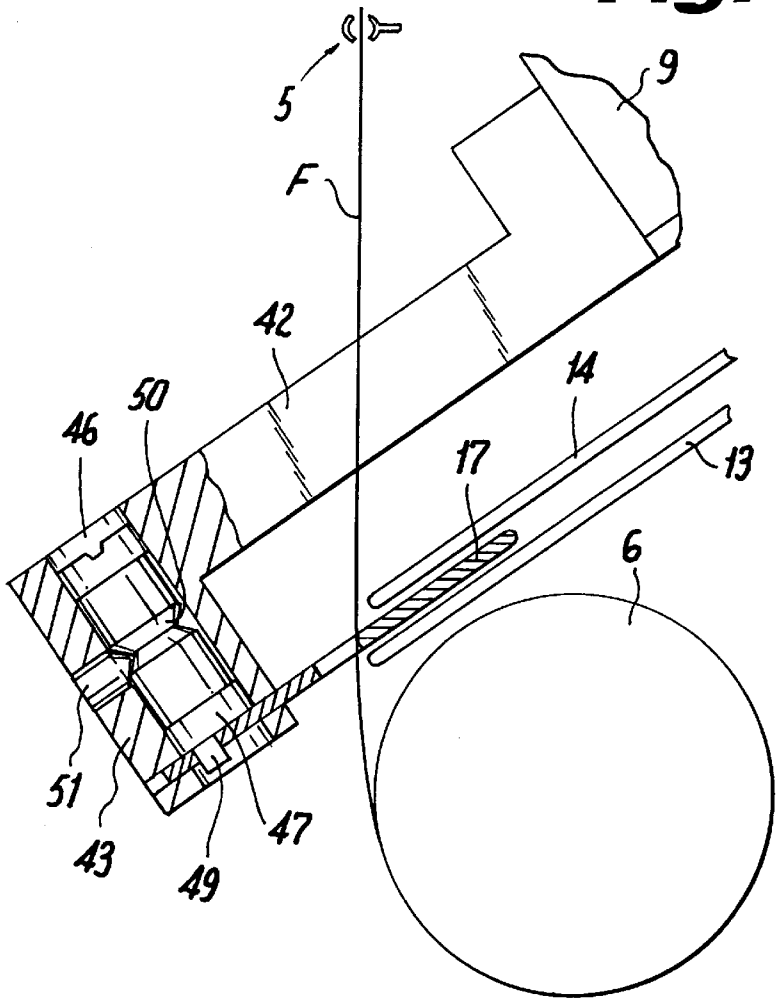

FIGS. 4*a* and 4*b* show the adjusting pin in the locked and released position, respectively.

Figure 5C:
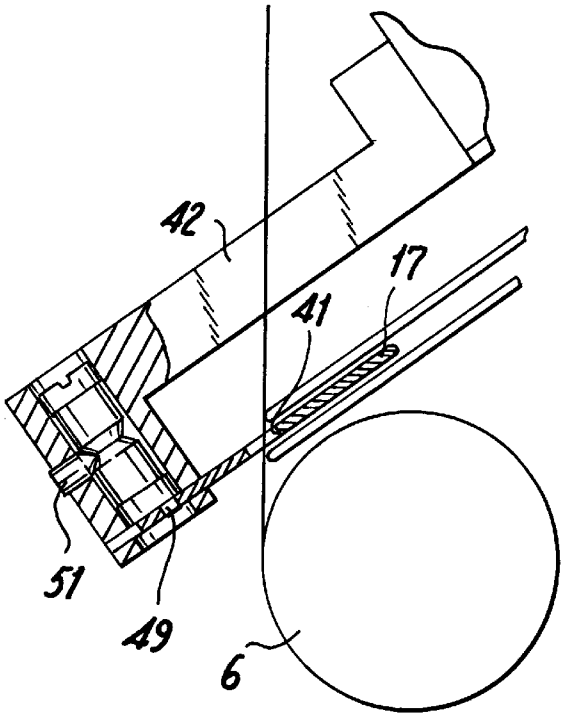
Figure 5B:
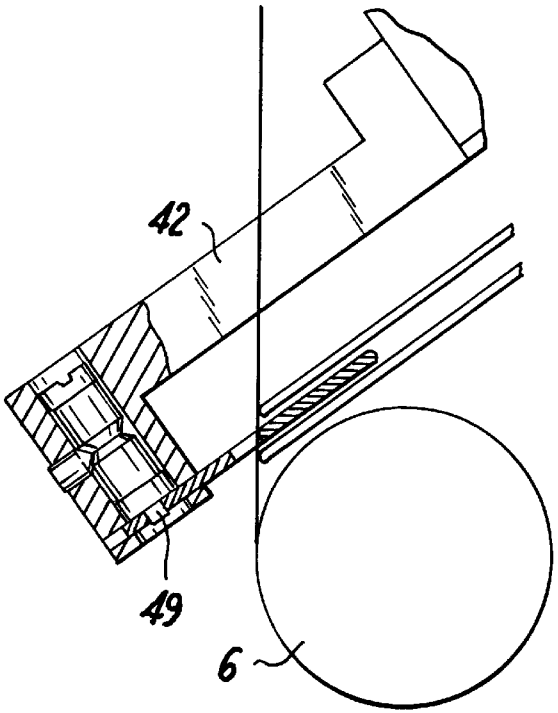
Figure 5A:
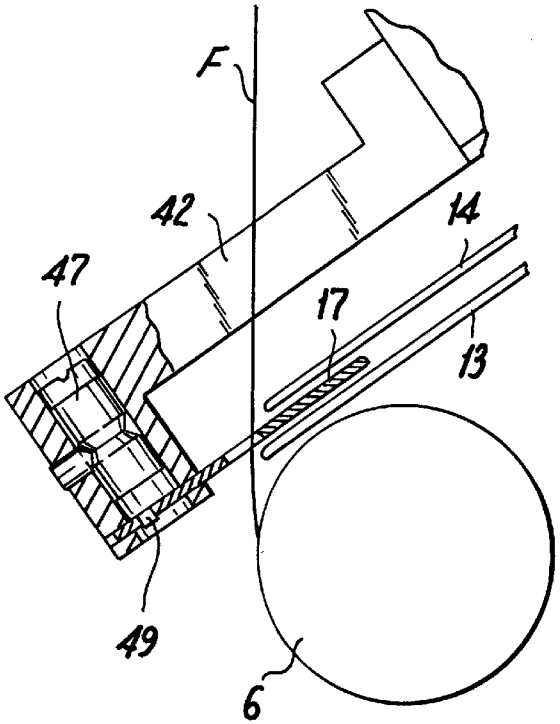

FIGS. 5*a* and 5*c* show various settings of the straightedge.

DESCRIPTION OF PREFERRED EMBODIMENTS

Figure 1:
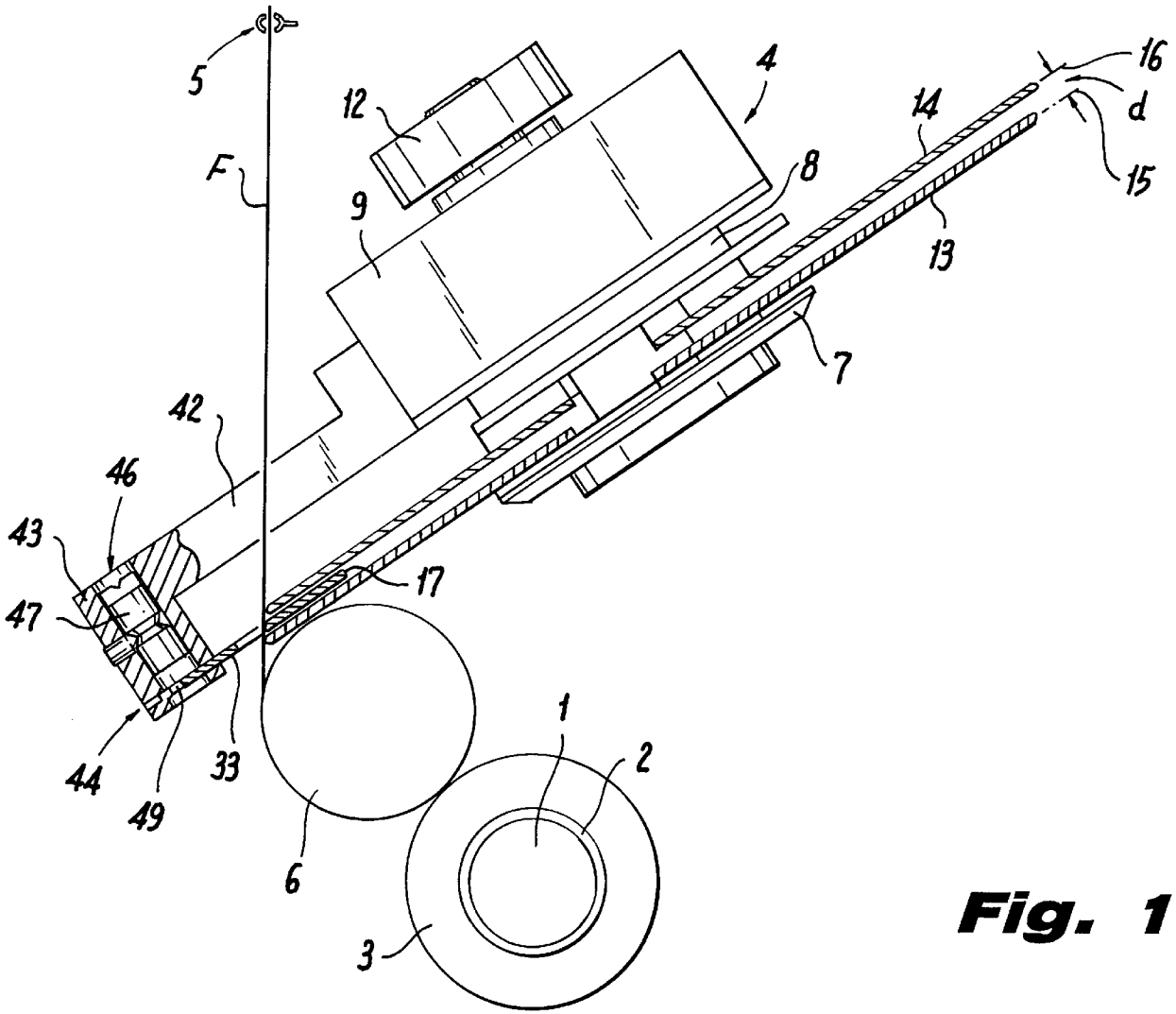
FIG. 1 shows a side view of a bobbin winder with a traversing device according to the invention, shown partly in section.

A bobbin spindle 1, on which a bobbin tube 2 of a bobbin 3 now being formed is mounted and is connected in a known manner to a machine frame, not shown in FIG. 1. A traversing device 4 for a yarn F, which is delivered vertically from above via a yarn guide 5, is likewise secured to the machine frame, above the bobbin spindle 1. A contact roller 6, whose axis is oriented horizontally and parallel to the axis of the bobbin spindle 1, is disposed between the bobbin spindle 1 and the traversing device 4.

Figure 2:
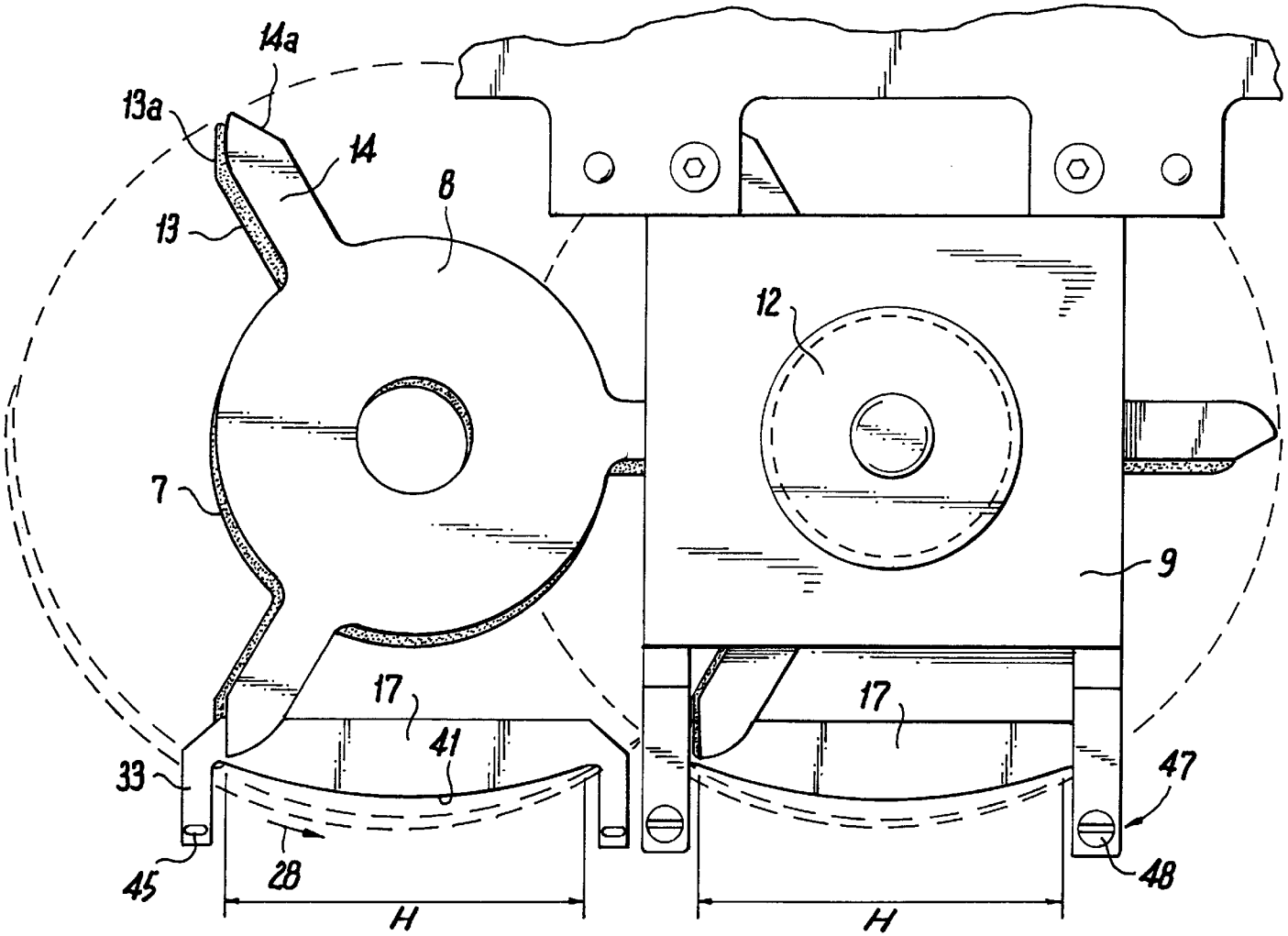
FIG. 2 shows a plan view on two traversing units, located side by side, of a multistation bobbin winder machine, in which the traversing unit on the left in the drawing schematically represents only the location of the rotors and the straightedge, without the housing and the gear.
Figure 3:
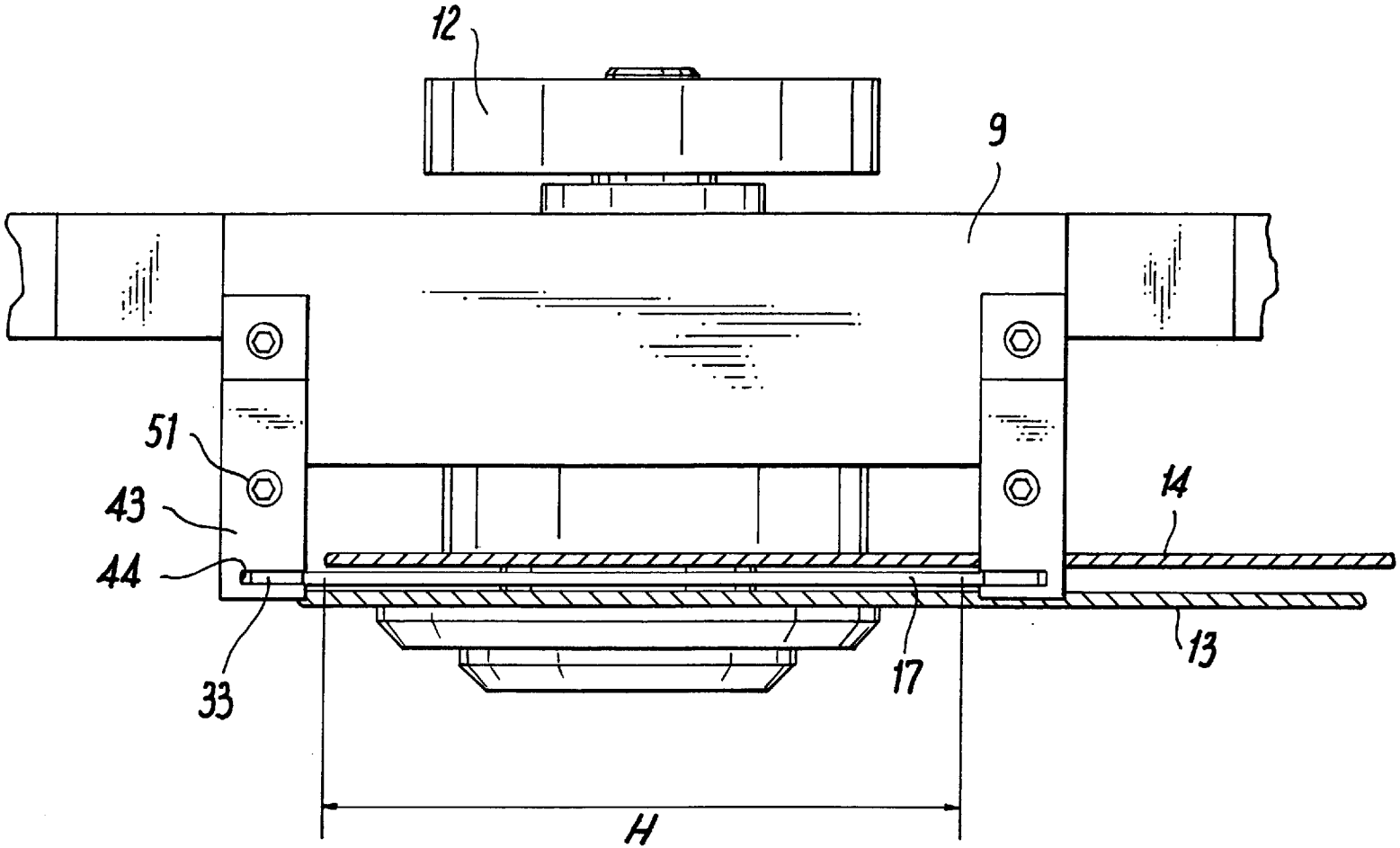
FIG. 3 shows a front view.

The traversing device 4 includes two rotors 7, 8, which are rotatably supported in a housing 9. Their pivot axes, as known for instance from German Utility Model DE 93 07 746 U, are disposed parallel to one another and spaced apart by short distances. By means of a drive mechanism, of which only one toothed disk 12 belonging to the rotor 7 can be seen in FIG. 1, the rotors 7, 8 are drivable in opposite directions at the same rpm. The rotor 7—as can be seen in FIG. 2—has three vanes 13, arranged in the manner of a propeller, and the rotor 8 has correspondingly arranged vanes 14. As shown in FIG. 2, in the vicinity of its tip on the leading side in terms of the direction of rotation, each vane 13 has a yarn guide edge 13*a* and each vane 14 has a yarn guide edge 14*a*.

The vanes 13 of the rotor 7 revolve in a lower plane of rotation 15, and the vanes 14 of the rotor 8 revolve in an upper plane of rotation 16. The short distance between the two rotation planes 15, 16 is d. The axes of the rotors 7, 8 are tilted, so that the two rotation planes 15, 16 form an acute angle with the plane of the traversing triangle in FIG. 1.

A straightedge 17 is disposed between the two rotation planes 15, 16. On the side remote from the pivot axes of the rotors 7, 8, the straightedge has a guide edge 41, essentially in the form of a convex arc. The guide edge 41 extends over the traversing stroke H, which is defined essentially (that is, except for small deviations dictated particularly by the tilt of the traversing device), by the location of the points at which the orbits of the vanes 13, 14 intersect the guide edge 41. Tabs 33 that are oriented at right angles to the line connecting the two end points of the guide edge 41 are mounted on both ends of the straightedge 17, on the side remote from the pivot axes. The straightedge 17 is secured to lateral arms 42, which are screwed firmly in mirror symmetry to one another onto the front wall of the housing 9 and are disposed above the upper rotation plane 16, being spaced apart therefrom. The distance between the two arms 42 is only slightly greater than the traversing stroke H. Each arm 42 has a downward-pointing, blocklike attachment 43 on its free end. This attachment, in the vicinity of its lower end face, is provided with a slot 44 that is parallel to that end face. The tab 33 rests with slight lateral play in the slot 44. The tab is provided with a crosswise-extending oblong slot 45.

The attachment 43 has a continuous bore 46. Inserted in it is an adjusting bolt 47, whose upper end face, in the manner of the head of a screw, is provided with a slot 48.

Mounted on its lower end face is an eccentric pin 49, which engages the oblong slot 45. The adjusting bolt 47 has an encompassing groove 50 of V-shaped cross section. It is engaged by the conical tip of a clamping screw 51. The cone angle corresponds to the angle between the side faces of the groove 50 and amounts to approximately 90°. The clamping screw 51 is seated in a threaded bore that penetrates the end face of the attachment 43.

To adjust the straightedge 17, the clamping screw 51 is loosened, or in other words is moved out of the position shown in FIG. 4*a* into the position of FIG. 4*b*. Its tip now no longer engages the groove 50, so that now the adjusting bolt 47 is freely rotatable. By rotating the adjusting bolt, for instance into one of the positions shown in FIGS. 5*a*–5*c*, the end of the straightedge 17 can be displaced, in the direction in which the tab 33 extends, inside the frame defined by the eccentricity of the eccentric pin 49. A corresponding adjustment can also be made on the other end of the straightedge 17. As a result, the straightedge 17 can not only be displaced parallel to itself but also pivoted within a small angular range. The lateral play with which the tabs 33 rest in the grooves 44 should be dimensioned such that this pivoting is not hindered. On the other hand, it is so slight that no perceptible displacement in the stroke direction can occur. Once the optimal position of the straightedge 17 is attained, the clamping screws 51 are tightened on both sides, so that the conical tips again engage the grooves 50 of the adjusting bolts 47. The conical form of the tip, in combination with the V-shaped groove cross section, has the effect that the adjusting bolt 47 is pressed by its lower end face firmly against the tab 33. In this way, the setting achieved is locked.

A particular advantage is that the adjusting bolts 47 with the clamping screws 51 are located outside the orbits of the vanes—as best seen in FIG. 2—and are freely accessible in operation from the control side—that is, from the side of the traversing plane opposite the machine frame. The effect of the adjustment is visible directly in the yarn travel and yarn transfer. An iterative optimizing process is therefore unnecessary. It accordingly also proves to be advantageous that the straightedge 17 can be replaced very easily.

We claim:

1. A traversing device, comprising a housing; two rotors supported in said housing and having axes located parallel to one another and spaced apart from one another by at most a slight distance, each of said rotors having at least two vanes arranged in the manner of a propeller so that between rotation planes of two vanes assemblies there is a short distance; a gear which couples said two rotors and drives said rotors so that one of said rotors is drivable in one direction while the other of said rotors is drivable in another opposite direction; a straightedge located in a parallel plane adjacent to two rotation planes and having a guide edge whose end points essentially correspond to turning points of a traversing motion; retaining devices and fasteners connecting said straight edge to said housing so as to permit a relative displacement, said straightedge being secured adjustably to said retaining devices that are rigidly connected to said housing so that said straightedge is directly connected with said housing; and adjusting means arranged outside orbits of said vanes and at a side of the traversing device which is opposite to a machine frame and being freely accessible from said side for performing the adjustment during operation of the traversing device.

2. A traversing device as defined in claim 1, wherein said adjusting means is formed as an adjusting bolt which is seated rotatably and lockingly in a bore of said retaining device; and further comprising an eccentric pin mounted on an end face of said adjusting bolt and engaging an opening of said straightedge.

3. A traversing device as defined in claim 2, where said guide edge is located on a side of said straightedge which is removed from said pivot axes of said rotors; and further comprising tabs mounted on ends of said straightedge on a side remote from said pivot axes and oriented at right angles to a line connecting end points of said guide edge, said tab being provided with a crosswise-extending oblong slot for said eccentric pin.

4. A traversing device as defined in claim 2, and further comprising a clamping screw which secures said adjusting bolt against rotation.

5. A traversing device as defined in claim 4, wherein said adjusting bolt has an encompassing groove with a V-shaped cross section, said clamping screw having a conical tip engaging said groove.

* * * * *